US009627749B2

(12) United States Patent
Misra et al.

(10) Patent No.: US 9,627,749 B2
(45) Date of Patent: Apr. 18, 2017

(54) RADIO-FREQUENCY TRANSPARENT WINDOW

(71) Applicant: Apple Inc., Cupertino, CA (US)

(72) Inventors: Abhijeet Misra, Mountain View, CA (US); Brian S. Tryon, Los Gatos, CA (US); Charles J. Kuehmann, Los Gatos, CA (US); Stephen B. Lynch, Portola Valley, CA (US); James A. Wright, Burlingame, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/078,949

(22) Filed: Mar. 23, 2016

(65) Prior Publication Data

US 2016/0204502 A1 Jul. 14, 2016

Related U.S. Application Data

(63) Continuation of application No. 13/913,382, filed on Jun. 7, 2013, now Pat. No. 9,300,036.

(51) Int. Cl.

| | |
|---|---|
| ***H01Q 1/24*** | (2006.01) |
| ***H01Q 1/42*** | (2006.01) |
| ***H01Q 1/44*** | (2006.01) |

(52) U.S. Cl.

CPC ..... *H01Q 1/42* (2013.01); *H01Q 1/243* (2013.01); *H01Q 1/44* (2013.01)

(58) Field of Classification Search

USPC ..... 343/700 MS, 702, 789, 872; 205/121, 205/122, 124

See application file for complete search history.

(56) References Cited

U.S. PATENT DOCUMENTS 5,648,655 A * 7/1997 Rostoker ..... H01L 27/14618 250/208.1

6,149,792 A 11/2000 Chakravorty (Continued)

FOREIGN PATENT DOCUMENTS

| | | |
|---|---|---|
| EP | 2402139 | 12/2010 |
| JP | 2001327917 | 11/2001 |

(Continued)

OTHER PUBLICATIONS

PCT Search Report for International Application No. PCT/2014/040327 dated Sep. 24, 2014.

(Continued)

*Primary Examiner* — Tho G Phan

(74) *Attorney, Agent, or Firm* — Brownstein Hyatt Farber Schreck, LLP

(57) ABSTRACT

A patch for a device in an electronic housing including an aluminum layer having a threshold thickness, a non-conductive layer on a first side of the aluminum layer, and a radio-frequency (RF) transparent layer on a second side of the aluminum layer is provided. A method for manufacturing an antenna window including a patch as above is also provided, the method including determining a thickness of the aluminum layer adjacent to an anodized aluminum layer. A method for manufacturing an antenna window including coating an aluminum layer having a threshold thickness on a radio-frequency (RF) transparent layer to form an RF transparent laminate is also provided. A method for manufacturing an antenna window including removing a thickness of aluminum is also provided. A method for manufacturing an antenna window including disposing a mask on an aluminum substrate and anodizing the aluminum substrate to a selected thickness is also provided.

20 Claims, 14 Drawing Sheets

(56) References Cited

U.S. PATENT DOCUMENTS

| | | | | |
|---|---|---|---|---|
| 6,603,432 | B2 * | 8/2003 | Hill | H01Q 1/243 343/700 MS |
| 7,498,392 | B2 | 3/2009 | Nelson | |
| 8,102,321 | B2 | 1/2012 | Chiang et al. | |
| 8,269,675 | B2 | 9/2012 | Kough et al. | |
| 8,325,094 | B2 | 12/2012 | Ayala Vazquez et al. | |
| 8,947,303 | B2 * | 2/2015 | Golko | G06F 1/1698 343/702 |
| 9,093,752 | B2 * | 7/2015 | Yarga | H01Q 5/328 |
| 2006/0183342 | A1 | 8/2006 | Bruyns et al. | |
| 2006/0244663 | A1 * | 11/2006 | Fleck | G06F 1/1616 343/700 MS |
| 2008/0191948 | A1 | 8/2008 | Hu et al. | |
| 2010/0045538 | A1 | 2/2010 | East et al. | |
| 2010/0321253 | A1 | 12/2010 | Ayala Vazquez et al. | |
| 2013/0008796 | A1 | 1/2013 | Silverman et al. | |
| 2013/0009833 | A1 | 1/2013 | Kough et al. | |
| 2013/0050032 | A1 | 2/2013 | Shiu et al. | |
| 2014/0009355 | A1 | 1/2014 | Samardzija et al. | |
| 2014/0125528 | A1 * | 5/2014 | Tsai | H01Q 13/106 343/702 |
| 2014/0361934 | A1 | 12/2014 | Ely et al. | |

FOREIGN PATENT DOCUMENTS

| | | |
|---|---|---|
| JP | 2003089165 | 3/2003 |
| JP | 2003261381 | 9/2003 |
| JP | 2005275405 | 10/2005 |
| WO | WO 2007/001683 | 1/2007 |
| WO | 2011051408 | 5/2011 |

OTHER PUBLICATIONS

PCT Written Opinion for International Application No. PCT/2014/040327 dated Sep. 24, 2014.

* cited by examiner

RADIO-FREQUENCY TRANSPARENT WINDOW

CROSS-REFERENCE TO RELATED APPLICATIONS

This application is a continuation of U.S. patent application Ser. No. 13/913,382, filed Jun. 7, 2013. The above identified application is incorporated by reference herein in its entirety for all purposes.

FIELD OF THE DESCRIBED EMBODIMENTS

The described embodiments relate generally to housings for electronic devices adapted to include radio-frequency (RF) antennas. More particularly, embodiments disclosed herein relate to metallic housings for portable electronic devices adapted to include radio-frequency antennas.

BACKGROUND

Antenna architecture is an integral part of portable electronic devices. Housings and structural components are often made from conductive metal, which can serve as a ground for an antenna. However, typical antenna designs use nonconductive regions that are transparent to radio-frequency (RF) radiation to provide a good radiation pattern and signal strength. Conventionally, antenna windows in portable electronic devices include a plastic antenna window or a plastic split in a housing forming a gap in the conductive metal. However, this approach breaks the consistent visual profile of the device, such as a cosmetic metal surface. Also, gaps in the device housing weaken the underlying metal and using product volume to fasten the parts together.

Therefore, what is desired is an RF transparent window that provides good signal quality to an antenna inside the housing of a portable electronic device while also providing structural support and visual consistency to the housing.

SUMMARY OF THE DESCRIBED EMBODIMENTS

In a first embodiment, a patch for a device in an electronic housing may include an aluminum layer having a threshold thickness to provide a selected radio-frequency (RF) transmissivity and structural support for the housing. The patch further includes a non-conductive layer on a first side of the aluminum layer; and an RF transparent layer on a second side of the aluminum layer.

In a second embodiment, a method for manufacturing an antenna window is provided. The method may include coating an aluminum layer on a substrate and anodizing the aluminum layer. Also, the method may include determining a thickness of the aluminum layer adjacent to the anodized aluminum layer, and stopping the anodizing the aluminum layer when the thickness of the aluminum layer adjacent to the anodized aluminum layer is determined to be no greater than a threshold thickness. In some embodiments the method includes determining the threshold thickness to provide a selected radio-frequency (RF) transmissivity and structural support for the housing.

In another embodiment, a method for manufacturing an antenna window is provided. The method may include coating an aluminum layer having a threshold thickness on a radio-frequency (RF) transparent layer to form an RF transparent laminate. Further, the method includes adhesively attaching the RF transparent laminate to a non-conductive window patch substrate.

In yet another embodiment a method for manufacturing an antenna window is provided, including the steps of: removing a thickness of aluminum in an electronic device housing to a first thickness to form a gap, and anodizing an aluminum surface of the electronic device housing. The method further includes removing residual aluminum to obtain an aluminum layer of a threshold thickness inside the gap and backfilling the gap with a supporting material. The threshold thickness may be selected to provide a desired RF transparence and structural support for the window.

In yet another embodiment, a method for manufacturing an antenna window includes disposing a mask on a first side of an aluminum substrate and anodizing a second side of the aluminum substrate to a second side thickness. The method further includes removing the mask from the first side of the aluminum substrate and anodizing a selected portion of the first side of the aluminum substrate to a first side thickness. Accordingly, the selected portion includes a radio-frequency (RF) transparent patch. In some embodiments the method includes selecting the first side thickness and the second side thickness so that the RF-transparent patch includes an aluminum substrate providing a selected RF transmissivity and structural support for the antenna window.

In yet another embodiment, A method of forming a thin substrate layer having a selected thickness, the method including forming a resistive layer within a conductive substrate, the resistive layer having a depth. The method may also include disposing anodization electrodes on points of the conductive substrate separated by the resistive layer, and anodizing the conductive substrate until anodization current stops. Accordingly, the selected thickness may be substantially equal to the depth of the resistive layer.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings. These drawings do not limit any changes in form and detail that may be made to the described embodiments. Any such changes do not depart from the spirit and scope of the described embodiments.

In the figures, elements referred to with the same or similar reference numerals include the same or similar structure, use, or procedure, as described in the first instance of occurrence of the reference numeral.

DETAILED DESCRIPTION OF SELECTED EMBODIMENTS

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

Embodiments disclosed hereinafter include antenna windows having a thin anodized layer of aluminum that may be transparent to electromagnetic radiation in the radio-frequency (RF) spectral range. Accordingly, antenna window patches as disclosed herein are visually consistent with a portable housing and thus cosmetically appealing for the consumer. Also, embodiments as disclosed herein provide adequate transmission of RF radiation for an antenna located inside the device. Accordingly, embodiments of antenna windows as disclosed herein have the visual appearance of aluminum while being RF-transparent.

Figure 1B:
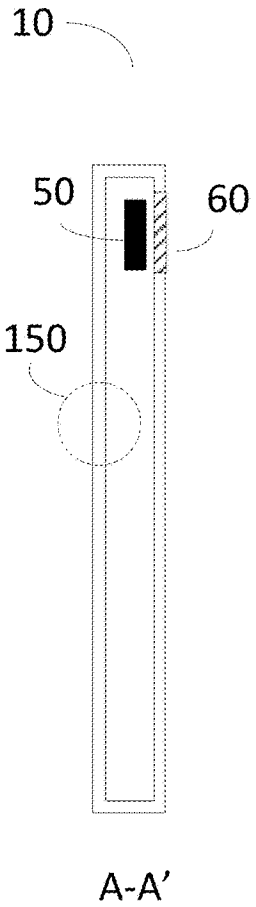
FIGS. 1A-1B illustrate a portable electronic device including a patch for an antenna window, according to some embodiments.
Figure 1A:
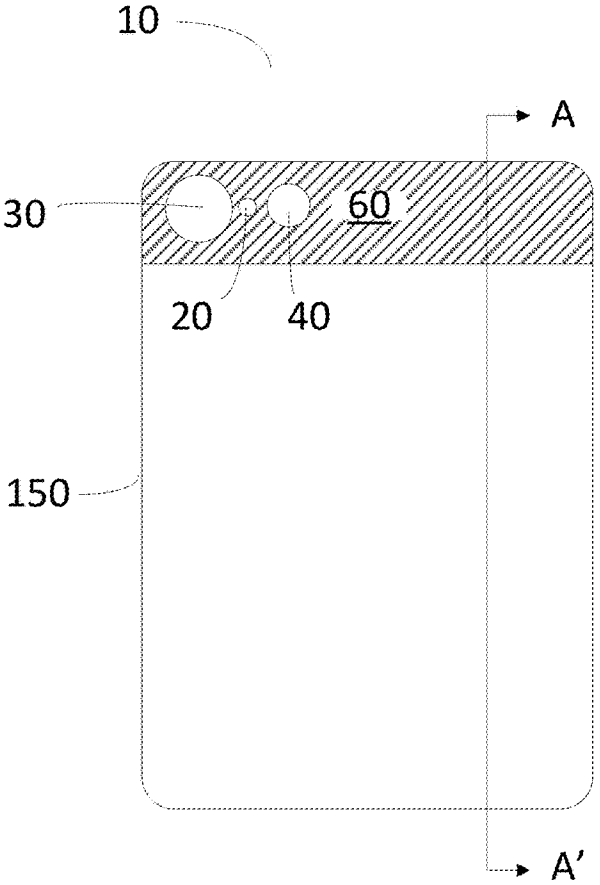

FIG. 1A illustrates a partial plan view of a portable electronic device 10 including a patch 60 for an antenna window, according to some embodiments. Portable electronic device 10 may be a laptop, a notepad, a tablet, or any other type of hand-held electronic device such as a smart phone. Portable electronic device 10 may include a housing 150. In some embodiments, housing 150 may be formed of a hard material providing structural support and thermal flow to the electronic circuitry inside electronic device 10. Accordingly, housing 150 may include a metallic material such as aluminum. In some embodiments, the antenna window includes apertures 20, 30, and 40. Apertures 20, 30, and 40 may be adapted to allow sensors such as a camera, a photo-detector, a proximity sensor, or an audio device to receive and send a signal through the antenna window.

FIG. 1B illustrates a partial cross-sectional view of portable electronic device 10 along line AA'. FIG. 1B illustrates housing 150 and patch 60 with antenna 50 in an interior portion of housing 150. Accordingly, antenna 50 is located proximal to patch 60, which acts as an RF transparent window to allow RF radiation flow into and out of antenna 50.

Figure 2:
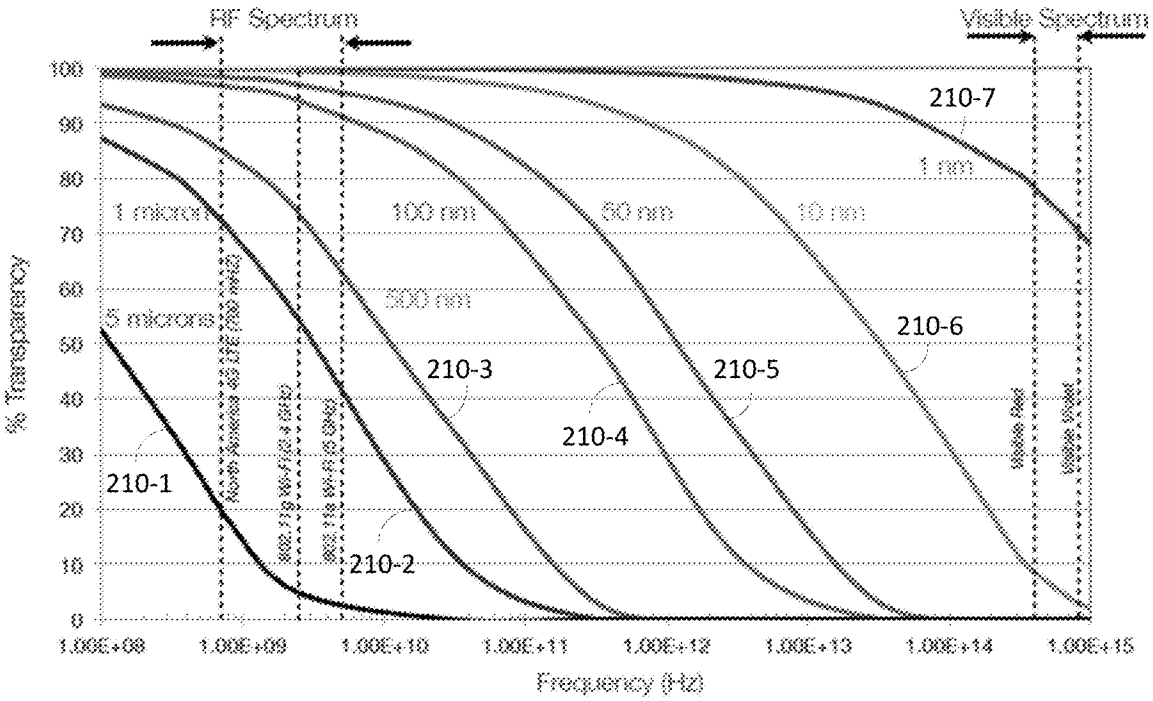
FIG. 2 illustrates multiple curves for transmissivity as a function of frequency for electromagnetic signals through aluminum layers having different thicknesses, according to some embodiments.

FIG. 2 illustrates multiple curves 210-1 through 210-7 for transmissivity as a function of frequency for electromagnetic signals through aluminum layers having different thicknesses, according to some embodiments. The abscissa in FIG. 2 indicates the frequency (in Hz) of an electro-magnetic radiation, and the ordinate indicates a transparency (in percent). 'Transparency' in the ordinate in FIG. 2 may also be referred to hereinafter as transmissivity. The chart in FIG. 2 indicates also two spectral regions: an RF spectrum (from about 1 GHz-$10^9$ Hz- to about 10 GHz), and a visible spectrum in the $10^{15}$ Hz region. Accordingly, embodiments of antenna windows as disclosed herein desirably have a high transmissivity in the RF-spectrum. The RF-spectrum depicted in FIG. 2 may include different frequency bands used for electronic appliances such as Wi-Fi (e.g., 802.11g at 2.4 GHz, and 802.11a at 5 GHz), Blue-tooth, cellular phone networks, and others well known in the art (e.g., North America 4G LTE at 700 MHz). In that regard, embodiments of the present disclosure may include multiple antenna windows configured to operate with antennas in different RF spectral bands, as described above. In fact, a portable electronic device may include one or more of each of a Wi-Fi antenna, a Bluetooth antenna, and a cellular phone network antenna.

Curves 210-1 through 210-7 (collectively referred hereinafter as curves 210) correspond to the electro-magnetic transmissivity spectrum (in percent) of an aluminum layer having varying thickness. Curve 210-1 corresponds to a 5 microns thick aluminum layer (1 micron=1 μm=$10^{-6}$ m). Curve 210-2 corresponds to a 1 μm thick aluminum layer. Curve 210-3 corresponds to a 500 nanometer thick aluminum layer (1 nanometer=1 nm=$10^{-9}$ m). Curve 210-4 corresponds to a 100 nm thick aluminum layer. Curve 210-5 corresponds to a 50 nm thick aluminum layer. Curve 210-6 corresponds to a 10 nm thick aluminum layer. And curve 210-7 corresponds to a 1 nm thick aluminum layer. Accordingly, curves 210-2, 210-3, 210-5, and 210-6 show good transmission of electromagnetic radiation in the RF spectrum, while being substantially opaque in the visible spectrum (with transmission well below 10%).

According to well-established electromagnetic theory, the amplitude 'E' of a propagating electric field having amplitude 'Eo' on one side of a material layer having thickness 'd' is given on the other side of the slab as:

$$E=E_0\cdot\exp(-d/\delta).$$

Where 'd' is the material layer thickness, and δ is a 'skin depth' which is dependent on material properties as $$\delta=\sqrt{\frac{2\rho}{\omega\mu}}.$$

Where ρ is the resistivity of the material, ω is the frequency of the electromagnetic radiation (abscissa in FIG. 2) and μ is the magnetic permeability of the material. As FIG. 2 indicates, antenna windows as disclosed herein include aluminum layers having a substantially reduced thickness. Notably, as FIG. 2 illustrates, aluminum layers of only a few nm thickness are optically opaque. In fact, embodiments providing an RF-transmissivity of more than 60% include aluminum layers having a thickness of approximately 500 nm or even less. Accordingly, methods for manufacturing antenna windows including aluminum layers having such thickness will be disclosed in relation to FIGS. 3A-3C through 14A-14B, described in detail below.

Figure 3A:
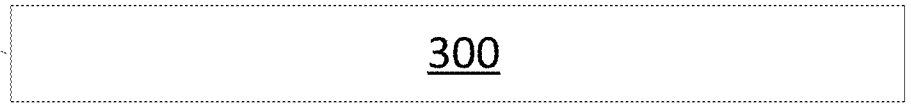
FIGS. 3A-3C illustrate steps in a method for manufacturing an antenna window, according to some embodiments.
Figure 3B:
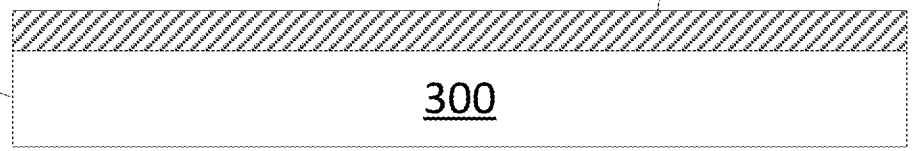
Figure 3C:
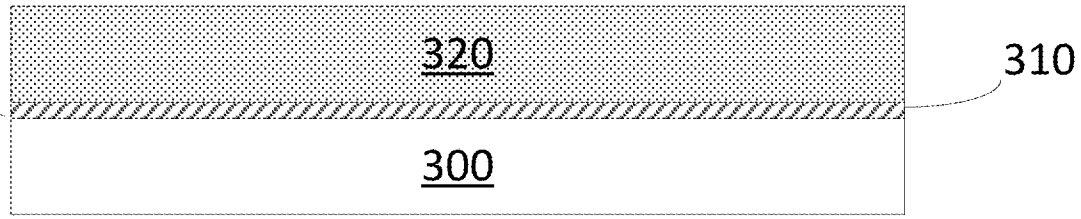

FIGS. 3A-3C illustrate steps in a method for manufacturing an antenna window, according to some embodiments. FIG. 3A shows a step of forming a transparent layer 300 of material, according to some embodiments. Transparent layer 300 is transparent at least in the visible spectrum. Transparent layer 300 may include a hard material such as glass, to provide structural integrity to the antenna window. FIG. 3B shows a step of coating a conductive material on transparent layer 300 to form hard material layer 310. Hard material layer 310 may include a hard material such as a metal. In some embodiments the hard material may be aluminum, and hard material layer 310 may be about 5 μm thick. Accordingly, the step in FIG. 3B may include metallization of a ceramics substrate by steps including ion vapor deposition, chemical vapor deposition (CVD), cathodic arc deposition, plasma spray deposition, and others known in the art.

FIG. 3C includes forming an RF-transparent layer 320 on top of hard material layer 310. In some embodiments, RF-transparent layer 320 may be formed by oxidizing layer 310. For example, RF-transparent layer 320 may be an alumina layer formed by anodizing a layer 310 made of aluminum. Accordingly, RF-transparent layer 320 may be non-conductive. In some embodiments RF-transparent layer 320 is transparent also to visible radiation. After anodizing hard material layer 310 to form RF-transparent layer 320, hard material layer 310 may be thinned down to a few tens of nm, such as 100 nm, or less. In some embodiments, the residual thickness of hard material layer 310 may be a few 100's of nm, and less than or about 500 nm. Thus, the RF transmissivity of hard material layer 310 may be 90% or more when the hard material layer includes an aluminum layer (e.g., curve 210-4, cf. FIG. 2). In some embodiments, the RF transmissivity of hard material layer 310 may be 60% or more, when the hard substrate layer includes a 500 nm thick aluminum layer, or thinner (e.g., curve 210-3 through 210-7, cf. FIG. 2).

In embodiments where hard material layer 310 includes an aluminum layer, anodization in FIG. 3C creates an alumina layer thicker than the consumed aluminum layer. Accordingly, an alumina layer of about twice the thickness of the consumed aluminum layer is produced in the oxidation step of FIG. 3C. The thickness of an aluminum layer resulting from oxidation step 720 may be a few nm (e.g., 10 nm), a few 100's of nm, a micron, or even more, such as a few microns or up to 5 μm or even 10 μm. Likewise, the thickness of RF-transparent layer 320 (alumina) may be from a few microns up to about 10 μm, 20 μm, or even more, such as 100 μm.

Figures 4A, 4B, 4C, 4D, 4E:
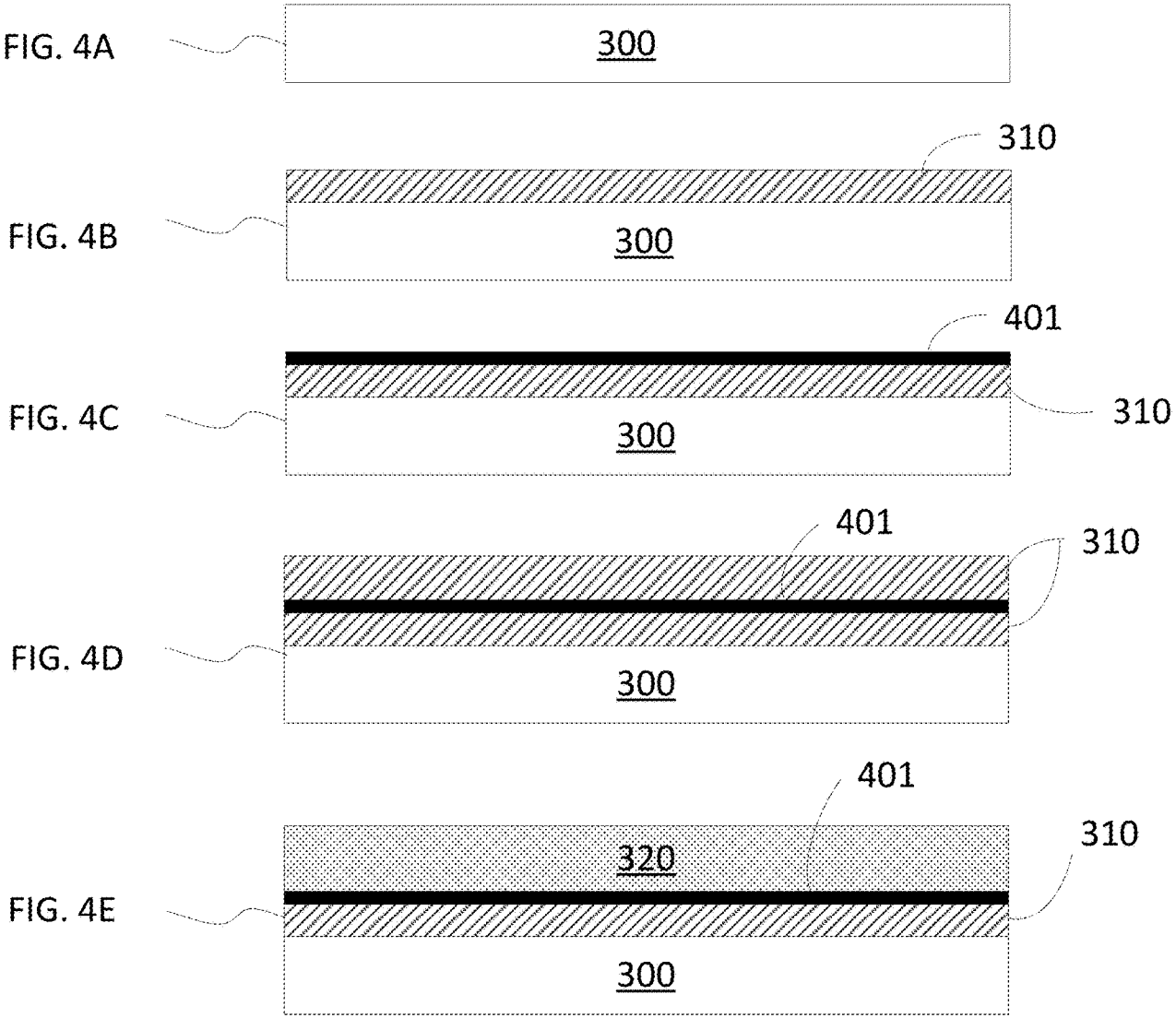
FIGS. 4A-4E illustrate steps in a method for manufacturing an antenna window including a stop layer, according to some embodiments.

FIGS. 4A-4E illustrate steps in a method for manufacturing an antenna window including a stop layer, according to some embodiments. FIG. 4A illustrates a step of forming transparent layer 300 of material. In that regard, the step in FIG. 4A may be similar to the step illustrated in FIG. 3A, above. FIG. 4B illustrates a step of coating a conductive material on transparent layer 300 to form conductive layer 310. In that regard, the step in FIG. 4B may be similar to the step illustrated in FIG. 3B, above. FIG. 4C illustrates a step of forming a transparent layer 401 on top of conductive layer 310. In some embodiments, transparent layer 401 may also be electrically conductive. Accordingly, in some embodiments the step illustrated in FIG. 4C includes depositing a layer of Indium Tin Oxide (ITO) over conductive layer 310. ITO is an electrically conductive material that is also transparent in the visible spectral region.

FIG. 4D illustrates a step of depositing hard material layer 310 over transparent layer 401. In that regard, the step in FIG. 4D may be similar to the step illustrated in FIGS. 3B and 4B. FIG. 4E illustrates a step of forming an RF-transparent layer 320 from hard material layer 310. Accordingly, RF-transparent layer 320 may be formed by anodization of top conductive layer 310 (cf. FIG. 3C). In that regard, transparent layer 401 serves two purposes. In one hand transparent layer 401 forms a stop barrier for the anodization step forming RF-transparent layer 320. On the other hand, its electrical conductivity allows transparent layer 401 to form an electrode in the anodization process of top conductive layer 310.

A convenient feature of an antenna window manufactured as in FIGS. 4A-4E is that RF-transparent layer 320, being an anodized alumina layer, forms a seamless profile within device housing 150. Moreover, in some embodiments device housing 150 may have a specific color, such as black, which may be provided to the antenna window by dying the anodized alumina layer (i.e., RF-transparent layer 320). Furthermore, the profile of the antenna window according to FIGS. 4A-E is also seamless in texture, relative to device housing 150.

Figure 5A:
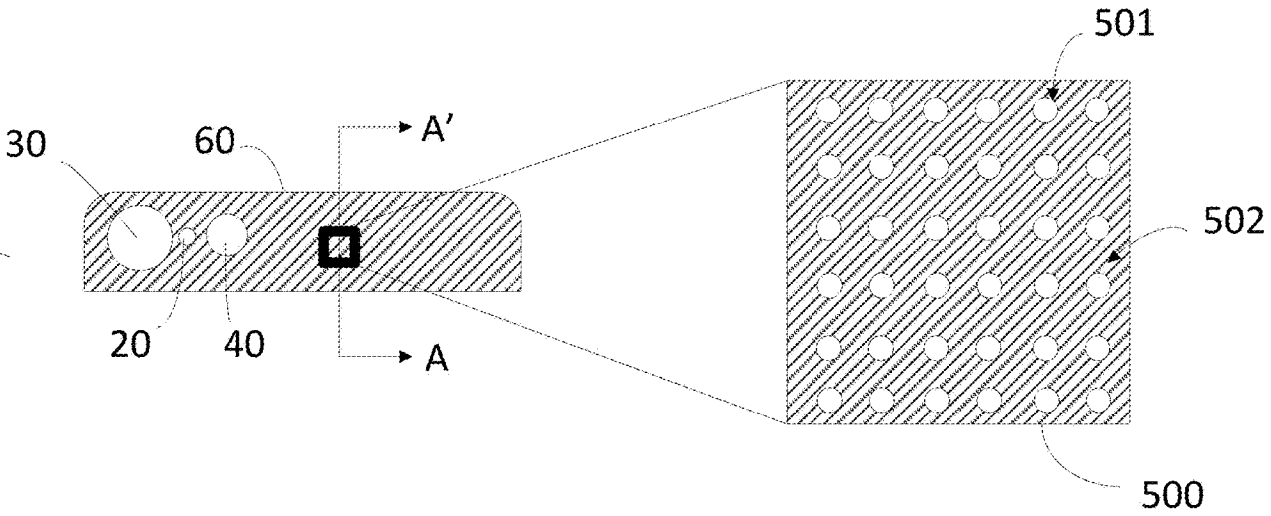
FIGS. 5A-5B illustrate an antenna window having a micro-perforated layer, according to some embodiments.
Figure 5B:
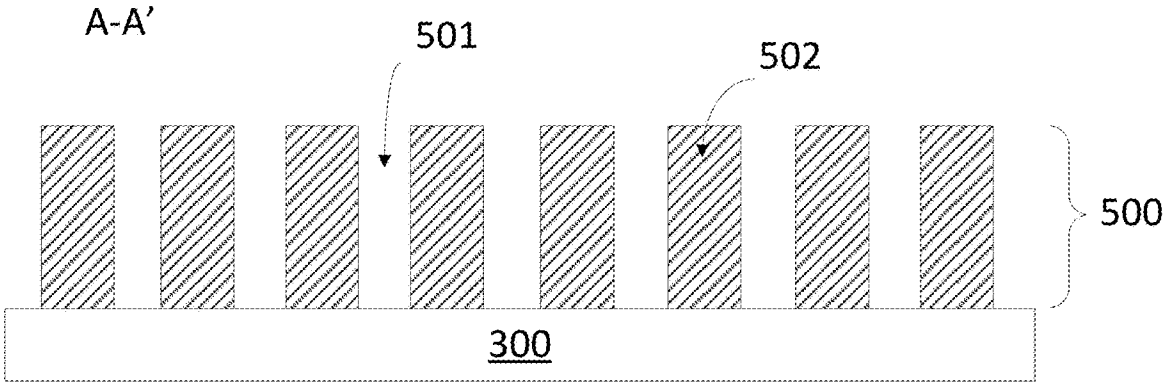

FIGS. 5A-5B illustrate an antenna window having a micro-perforated layer, according to some embodiments. FIG. 5A is a plan view of the antenna window including a patch 60 having apertures 20, 30, and 40 for accessing sensor and other accessory devices inside the electronic device. FIG. 5A also illustrates in higher detail a portion of patch 60 including micro-perforations 501 in a matrix 502. FIG. 5B illustrates a side view of patch 60 in the antenna window. Accordingly, patch 60 includes a microperf layer 500 adjacent to transparent layer 300. Microperf layer 500 includes micro-perforations traversing matrix 502 from one side to the opposite side of the matrix. In some embodiments, matrix 502 may be formed of a conductive material such as aluminum.

Micro-perforations 501 (microperf) allow RF radiation to pass through but are not visible to the eye. Micro-perforations 501 may be performed by laser machining of an aluminum surface. In some embodiments, micro-perforations 501 go through the aluminum layer and through an adjacent alumina layer. Microperf layer 500 may include perforations through the material and isolated islands of material separated by 'moats' or channels. In that regard, the 'moats' or channels forming the material islands may be formed by laser machining or chemical etching of the material.

Figures 6A, 6B, 6C:
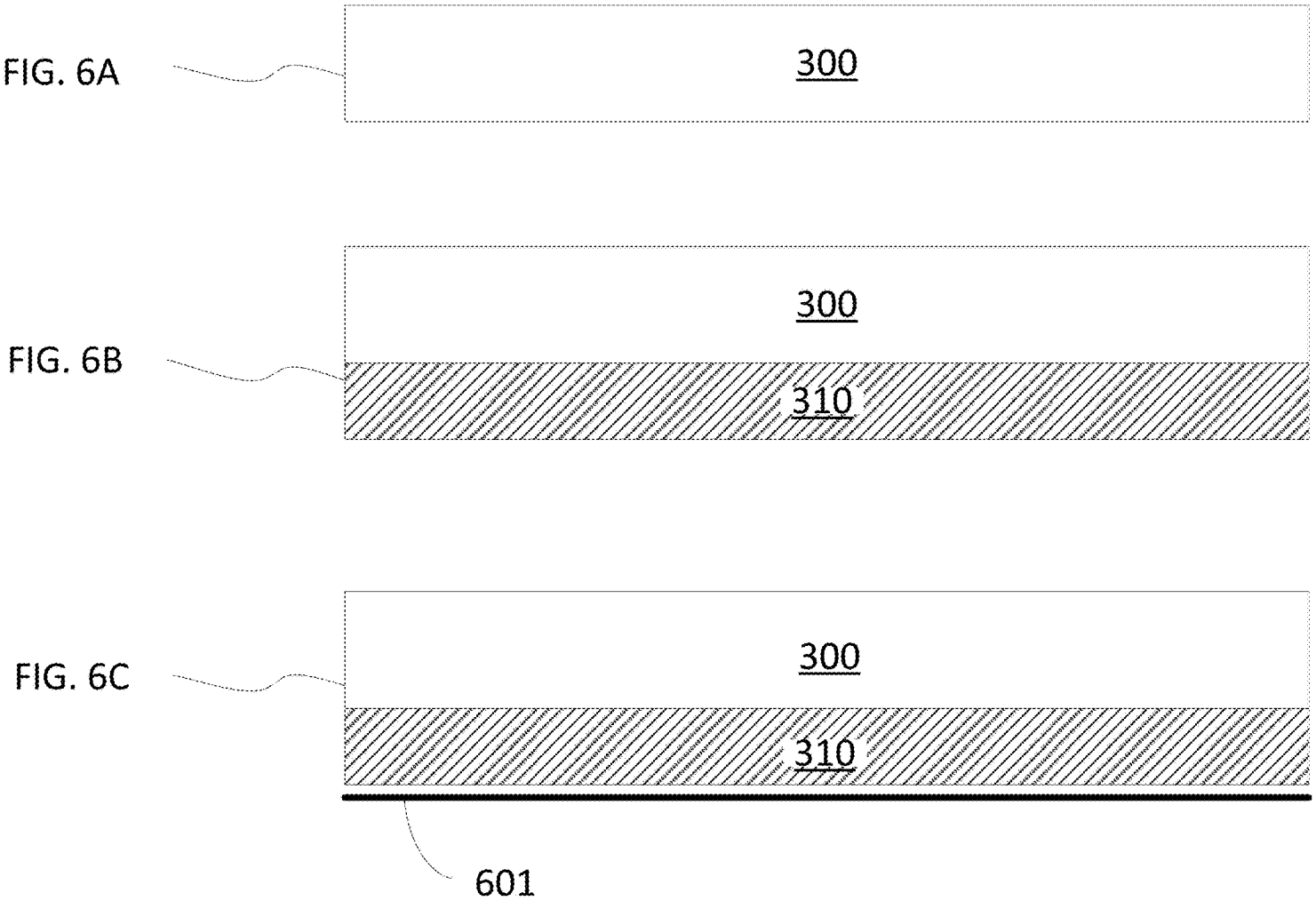
FIGS. 6A-6C illustrate steps in a method for manufacturing an antenna window including an ink layer, according to some embodiments.

FIGS. 6A-6C illustrate steps in a method for manufacturing an antenna window including an ink layer, according to some embodiments. FIG. 6A illustrates a step of forming a transparent layer 300 of material. Accordingly, the step in FIG. 6A may be as the step in FIG. 3A, above. FIG. 6B illustrates a step of depositing a conductive layer 310 on one side of transparent layer 300. In that regard, the step in FIG. 6B may be similar to the step in FIGS. 3B and 4B described in detail above. FIG. 6C illustrates a step of printing an ink layer 601 on a surface of conductive layer 310. In that regard, ink layer 601 may provide a cosmetically pleasing and consistent visual effect to the surface of housing 150. Thus, consumers may be attracted to acquire and use an electronic device consistent with the qualities described in the present disclosure.

Figure 7:
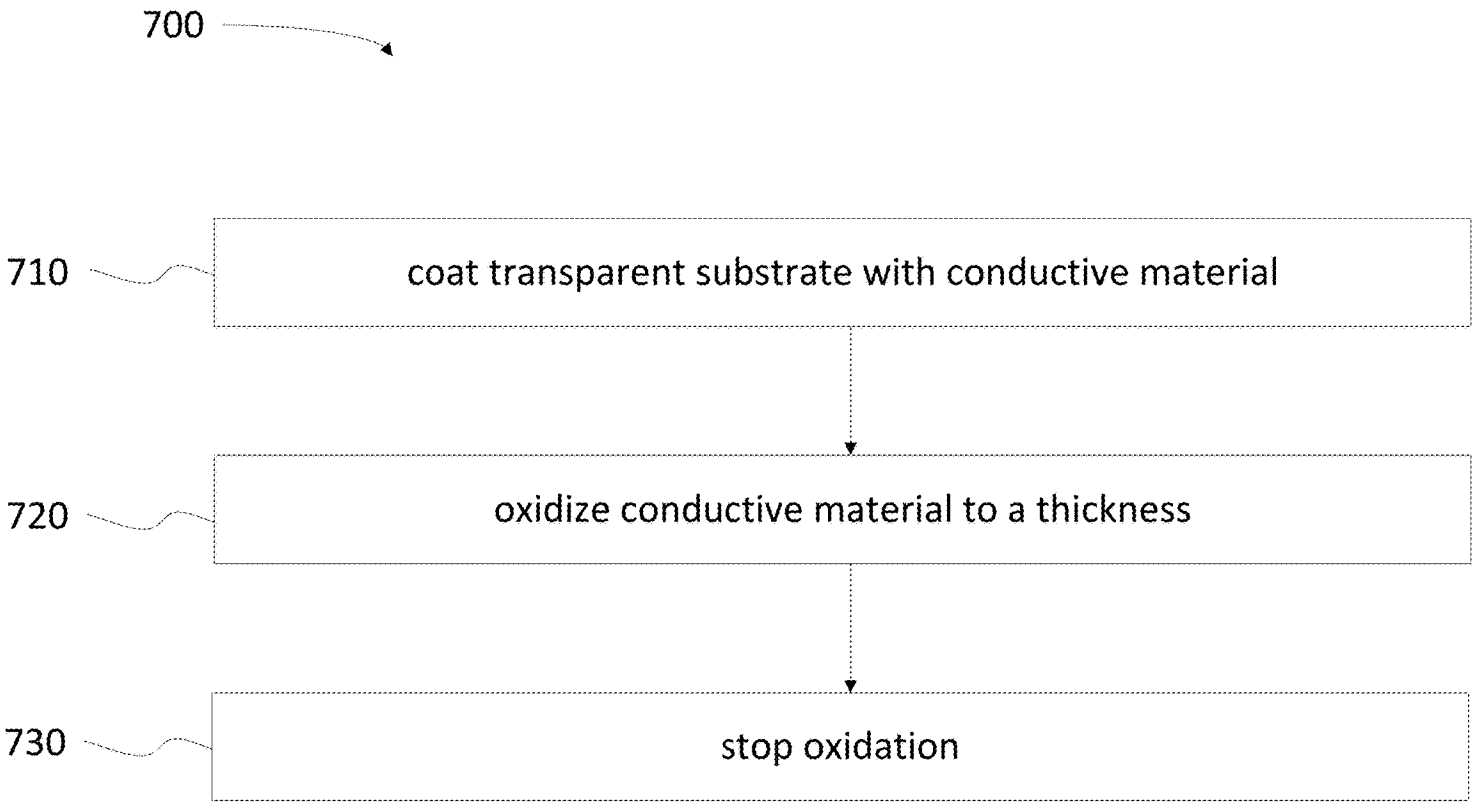
FIG. 7 illustrates a flow chart including steps in a method for manufacturing an antenna window including an oxidized layer, according to some embodiments.

FIG. 7 illustrates a flow chart including steps in a method 700 for manufacturing an antenna window including an oxidized layer, according to some embodiments. Step 710 includes coating a transparent substrate with a conductive material. A transparent substrate in step 710 may be a non-conductive substrate such as glass, which is transparent in the visible spectrum. Accordingly, step 710 may include forming hard material layer 310 adjacent to transparent layer as described in FIGS. 3B, 4B, and 6B. Step 720 includes oxidizing the conductive material coated in step 710 to a selected thickness. Accordingly, step 720 may include anodizing a conductive layer, such as an aluminum layer (e.g., hard material layer 310, cf. FIG. 3B). Step 730 includes determining that a pre-selected thickness of hard material layer 310 has been achieved. Further, step 730 includes stopping oxidation of the conductive material once the conductive material forms a hard material layer 310 of the pre-selected thickness. In some embodiments step 710 may include selecting a curve in a transmissivity spectrum according to a target RF transmissivity in the RF spectrum (e.g., curves 210, cf. FIG. 2).

Figure 8A:
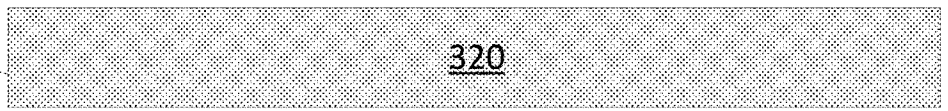
FIGS. 8A-8D illustrate steps in a method for manufacturing an antenna window including an adhesively attachable anodized layer, according to some embodiments.
Figure 8B:
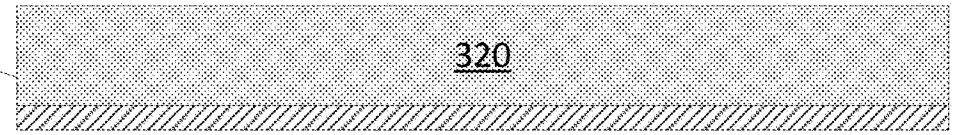
Figure 8C:
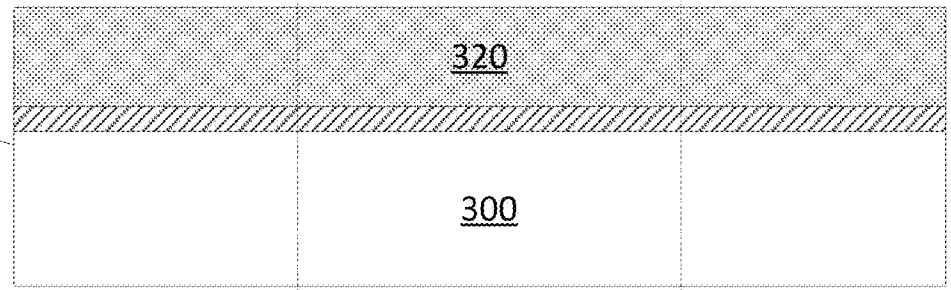
Figure 8D:
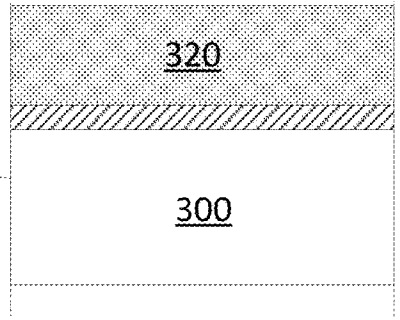

FIGS. 8A-8D illustrate steps in a method for manufacturing an antenna window including an adhesively attachable anodized layer, according to some embodiments. FIG. 8A illustrates a step forming an RF-transparent layer 320. RF-transparent layer 320 may be an oxidized layer, such as an aluminum oxide layer resulting from anodization step of an aluminum layer. In some embodiments it is desirable that RF-transparent layer 320 be thin, so as to be flexible. Accordingly, some embodiments include RF-transparent layer 320 made of glass and having a thickness of between about 25 to about 100 μm. FIG. 8B illustrates a step of depositing conductive layer 310 adjacent to RF-transparent layer 320. FIG. 8C illustrates a step of attaching the laminate formed by layers 310 and 320 onto transparent layer 300. Transparent layer 300 in FIG. 8C may be a hard transparent layer including a glass or a plastic. A hard transparent layer 300 is transparent in the visible spectrum and provides structural support for the antenna window. FIG. 8D illustrates a step of cutting a profile for an antenna window from a laminate including layers 300, 310, and 320. In some embodiments, the profile illustrated in FIG. 8D may be obtained by laser cutting the laminate formed in the steps illustrated in FIGS. 8A-8C. Accordingly, the profile in the cutting step in FIG. 8D may include apertures for sensors in the electronic device (e.g., apertures 20, 30, and 40, cf. FIG. 1A).

Figure 9:
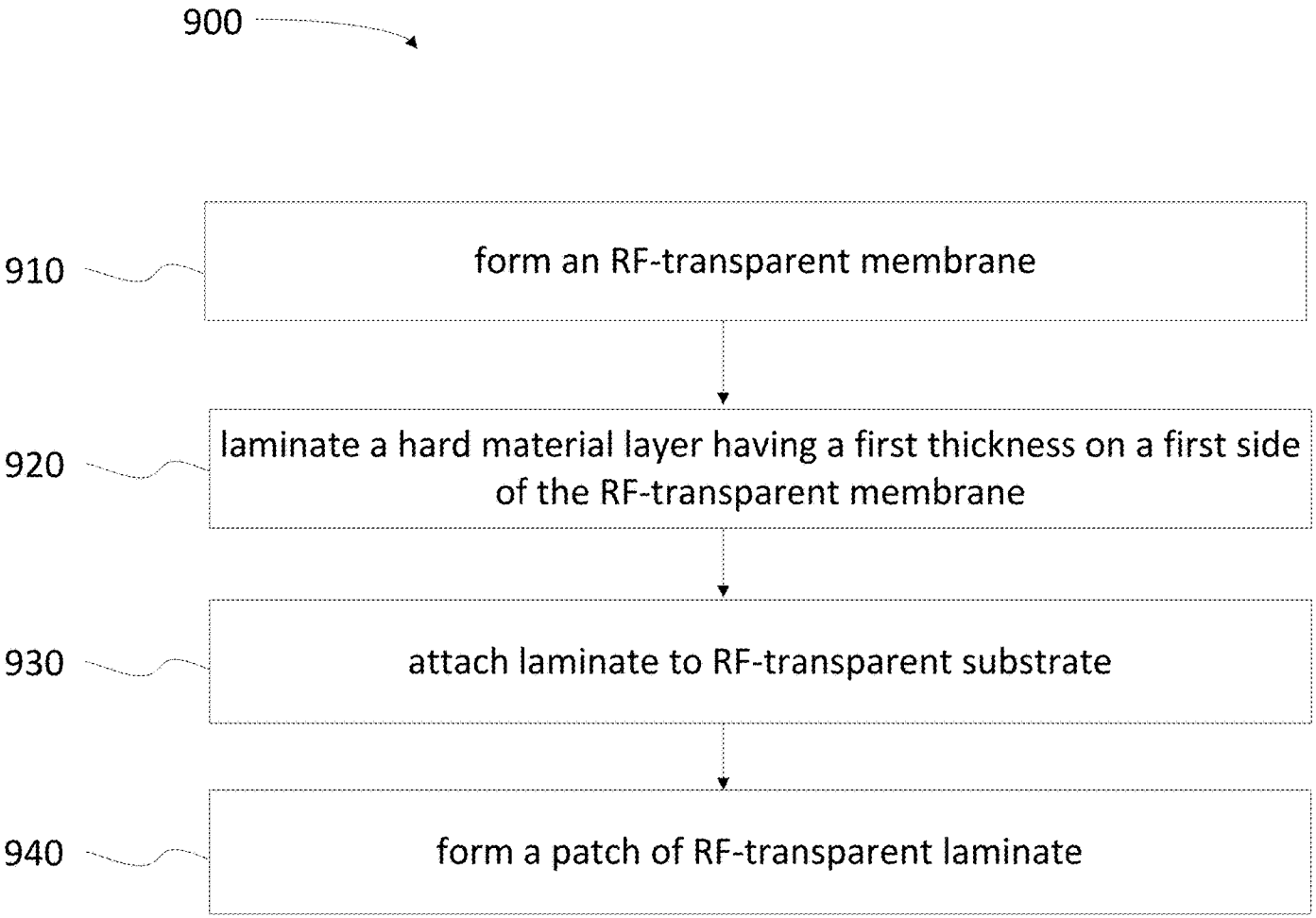
FIG. 9 illustrates a flow chart including steps in a method for manufacturing an antenna window including an adhesively attachable anodized layer, according to some embodiments.

FIG. 9 illustrates a flow chart including steps in a method 900 for manufacturing an antenna window including an adhesively attachable anodized layer, according to some embodiments. Step 910 includes forming an RF-transparent membrane. For example, step 910 may include anodizing an aluminum layer to form an alumina layer having a thickness and a porosity of a membrane. The porous alumina layer is also an RF-transparent material. Step 920 includes laminating a hard material layer having a first thickness on a first side of the RF-transparent membrane. For example, step 920 may include depositing an aluminum layer on the alumina membrane of step 910. Step 930 includes attaching the laminated hard material and RF-transparent membrane to a transparent substrate. Step 930 may include disposing an adhesive on a side of the hard material layer and pressing the laminate onto a surface of a glass layer (e.g., transparent layer 300, cf. FIG. 8C). Step 940 includes forming a patch of RF-transparent laminate from the composite of laminated hard material and RF-transparent membrane adhered to the transparent substrate resulting in step 930. Accordingly, in some embodiments step 940 may include cutting a profile for an antenna window from the laminate resulting in step 930 (cf. FIG. 8D).

Figures 10A, 10B, 10C, 10D, 10E, 10F:
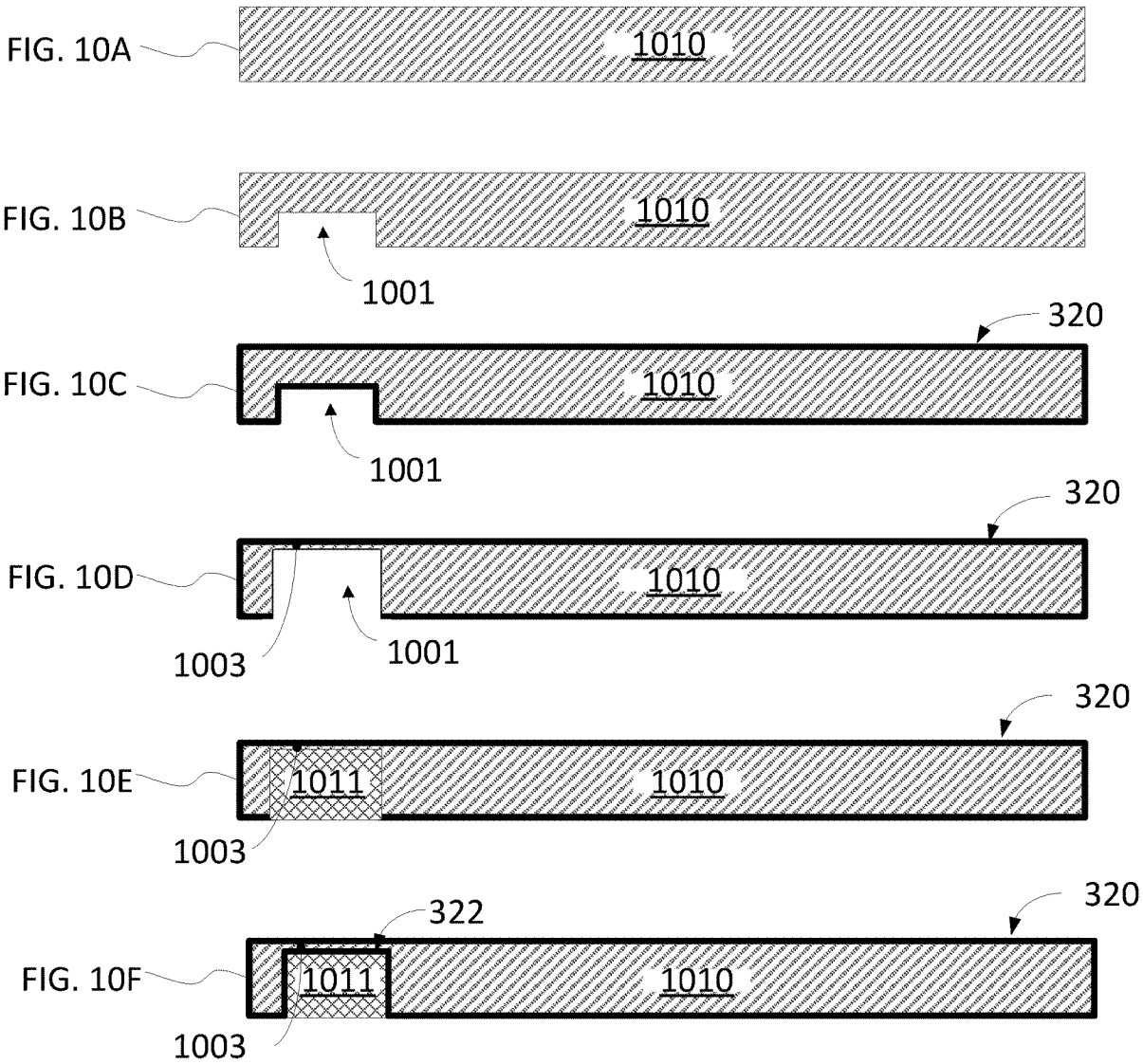
FIGS. 10A-10F illustrate steps in a method for manufacturing an antenna window including a machined aluminum layer, according to some embodiments.

FIGS. 10A-10E illustrate steps in a method for manufacturing an antenna window including a machined aluminum layer, according to some embodiments. FIG. 10A illustrates a step of forming a hard material layer 1010 formed of a generally RF opaque material. It should be noted that hard material layer 1010 can be any material amenable to forming an RF transparent layer on an exposed surface. For example, hard material layer 1010 can take the form of aluminum metal or alloy that is amenable to the formation of an aluminum oxide layer by way of an anodization process well known in the art. FIG. 10B illustrates a step of forming a gap 1001 on a portion of hard material layer 1010. The step illustrated in FIG. 10B may include machining hard material layer 1010 to form hard layer 1010 having gap 1001. Gap 1001 may form the profile of a patch including a portion of a housing adjacent to an antenna (e.g., patch 60 and housing 150 for antenna 50, cf. FIGS. 1A and 1B). FIG. 10C illustrates a step of forming an RF-transparent layer 320 on the surface of hard layer 1010, resulting in layer 1020. For example, FIG. 10C may include a step of anodizing hard material layer 1010 formed of aluminum to form a thin alumina (aluminum oxide) layer on the surface of layer 1010. In this particular embodiment the step to form layer 320 onto hard material layer 1010 may include dipping a portion or the entirety of hard material layer 1010 in an anodizing solution. FIG. 10D illustrates a step of increasing the depth of gap 1001. Accordingly, step 10D results in a thin aluminum portion 1003 in gap 1001 and adjacent RF-transparent layer 320. For example, a thin aluminum layer may remain on a side of a patch adjacent to the antenna to form the antenna window. The thin aluminum portion 1003 in gap 1001 thus provides structural support and continuity to layer 1010. The thickness of the thin aluminum portion 1003 in gap 1001 may be selected from a transmissivity spectrum such that RF radiation may be transmitted freely between the antenna and the exterior of the electronic device (e.g., curves 210, cf. FIG. 2). FIG. 10E illustrates a step of filling gap 1001 with an RF-transparent material 1011 to strengthen portion 1003. RF-transparent material 1011 may be a curable adhesive such as a thermosetting polymer. FIG. 10F illustrates an embodiment where an additional anodization process can be applied to the structure of FIG. 10D providing an additional RF transparent layer 322 within gap 1001 to provide, for example, additional structure support for layer 1003.

Figure 11:
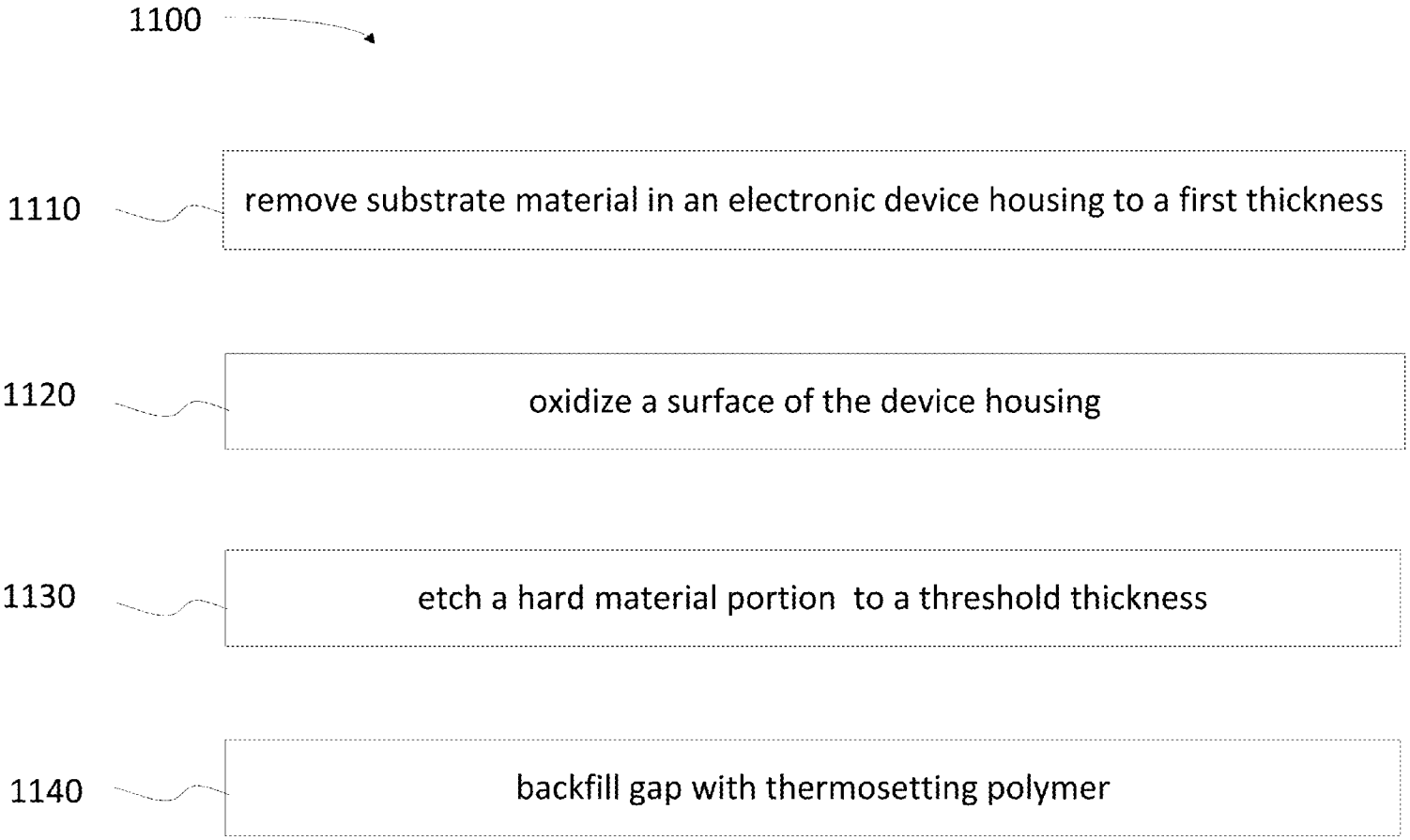
FIG. 11 illustrates a flow chart including steps in a method for manufacturing an antenna window including a machined aluminum layer, according to some embodiments.

FIG. 11 illustrates a flow chart including steps in a method 1100 for manufacturing an antenna window including a gap in housing 150, according to some embodiments. Step 1110 includes removing substrate material in an electronic device housing to a first thickness, forming a gap. Step 1120 includes oxidizing a surface of the device housing. Step 1130 includes removing residual material to obtain a threshold thickness of the hard material layer in the gap. Accordingly, step 1130 may include etching the hard material portion of the device housing down to the threshold thickness. Step 1140 includes backfilling the gap with a thermosetting polymer.

Figures 12A, 12B, 12C, 12D, 12E:
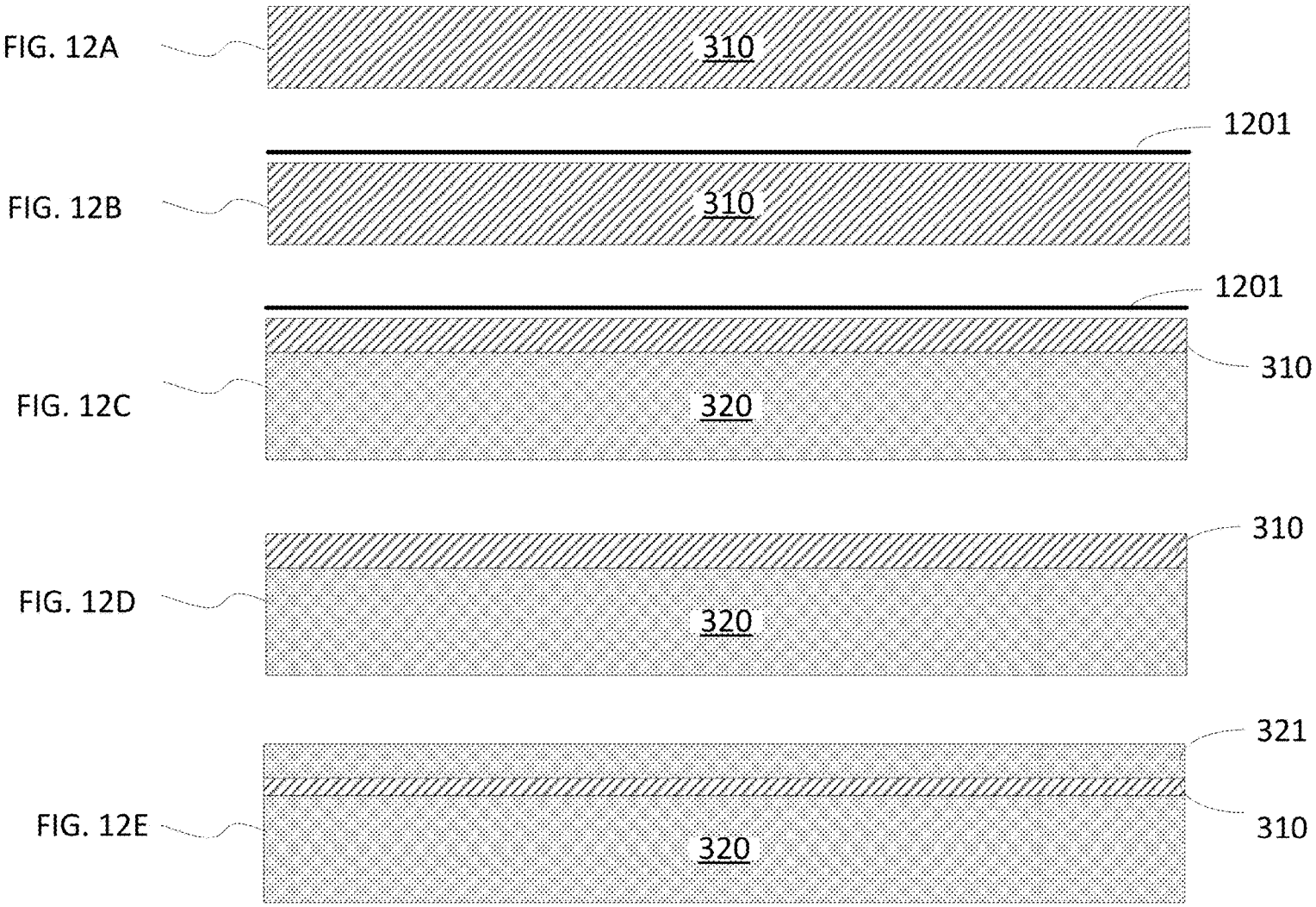
FIGS. 12A-12E illustrate steps in a method for manufacturing an antenna window including a masking step, according to some embodiments.

FIGS. 12A-12E illustrate steps in a method for manufacturing an antenna window including a masking step, according to some embodiments. FIG. 12A illustrates a step of forming a hard material layer 310. FIG. 12B illustrates the step of placing an oxidation mask 1201 adjacent to hard material layer 310. FIG. 12C illustrates the step of forming RF-transparent layer 320 on a side of the hard material layer opposite the mask. FIG. 12D illustrates a step of removing the mask. And FIG. 12E illustrates a step of forming a thin RF-transparent layer 321 adjacent to hard material layer 310, opposite to RF-transparent layer 320.

Figure 13:
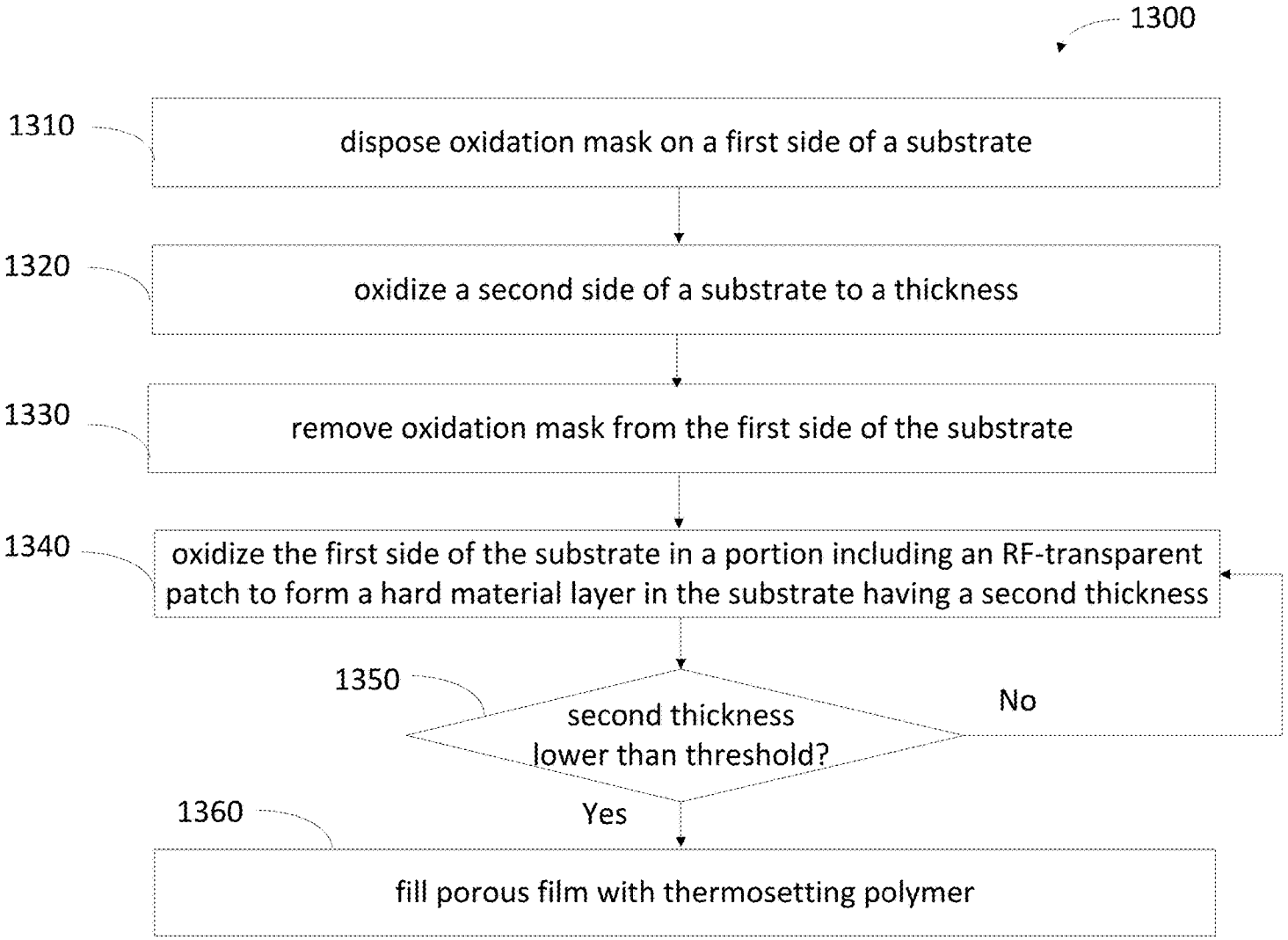
FIG. 13 illustrates a flow chart including steps in a method for manufacturing an antenna window including a masking step, according to some embodiments.

FIG. 13 illustrates a flow chart including steps in a method 1300 for manufacturing an antenna window including a masking step, according to some embodiments. Step 1310 includes disposing an oxidation mask on a first side of a substrate. The substrate may include a hard material layer (e.g., hard material layer 310 and mask 1201, cf. FIG. 12B). Accordingly, the hard material layer may include a metal, such as aluminum.

Step 1320 includes oxidizing a second side of the substrate to a thickness. In some embodiments, step 1320 may include anodizing an aluminum layer to a thickness, forming an RF-transparent layer (e.g., RF-transparent layer 320, cf. FIG. 12C). Step 1330 includes removing the oxidation mask from the first side of the substrate (cf. FIG. 12C). Accordingly, step 1330 may include selecting an RF-transparent patch in the substrate where the oxidation mask is to be removed. In some embodiments, the RF-transparent patch may include an RF antenna window for the electronic device (e.g., patch 60, cf. FIGS. 1 and 6). Step 1340 may include oxidizing the first side of the substrate in a portion including the RF-transparent patch to form a hard material layer in the substrate having a second thickness. Thus, step 1340 may include forming a thin RF transparent layer adjacent to the hard material layer (e.g., thin RF-transparent layer 321 and hard material layer 310, cf. FIG. 12E). Furthermore, step 1340 may include forming a thin hard material layer having a desired RF-transmissivity.

Step 1350 includes determining whether or not the second thickness is lower than a selected threshold. Accordingly, step 1350 may include selecting a threshold from a transmissivity spectrum curve (e.g., curves 210, cf. FIG. 2). For example, a threshold for a second thickness may be 10 nm for a hard substrate including aluminum. Accordingly, the RF-transmissivity of the resulting antenna window may be higher than about 99% (cf. curve 210-6 in FIG. 2). Step 1340 is continued until the second thickness is reduced below the selected threshold, according to step 1350. Step 1350 may include using electronic circuitry to measure an electric current in an anodization step included in step 1340. The intensity of the electric current in the anodization step is an indication of the thickness of an aluminum layer being anodized. Accordingly, the intensity of the anodization current is reduced as the thickness of the aluminum layer is reduced. In some embodiments, the reduction in anodization current may be proportional to the reduction in aluminum layer thickness. Thus, step 1350 may also include using a lookup table listing aluminum layer thicknesses corresponding to determined anodization currents. Thus, step 1350 may include measuring the anodization current and correlating the anodization current to an aluminum layer thickness to find the second thickness of the hard material layer in the substrate. Step 1360 includes filling the porous layer left as a result of the oxidation step 1340 with a thermosetting polymer when the second thickness is below the selected threshold, according to step 1350.

Figure 14A:
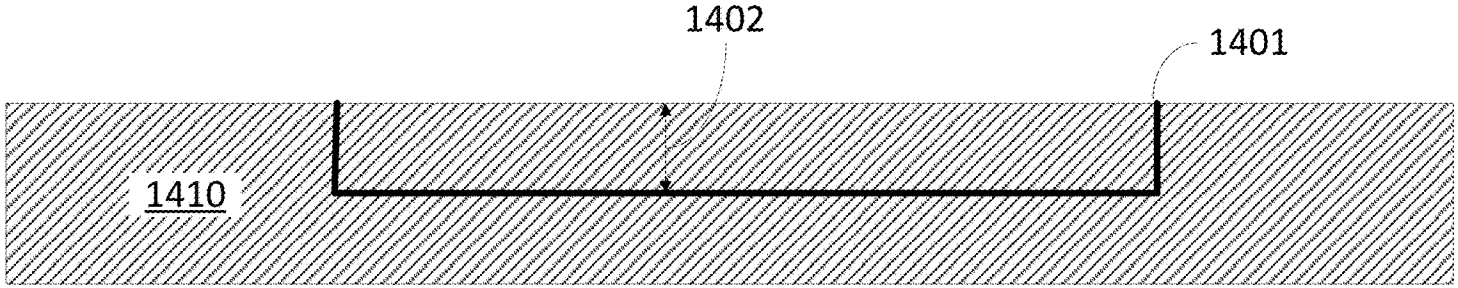
FIGS. 14A-14B illustrate steps in a method of forming a thin substrate layer having a selected thickness adjacent to an RF-transparent layer, according to some embodiments.
Figure 14B:
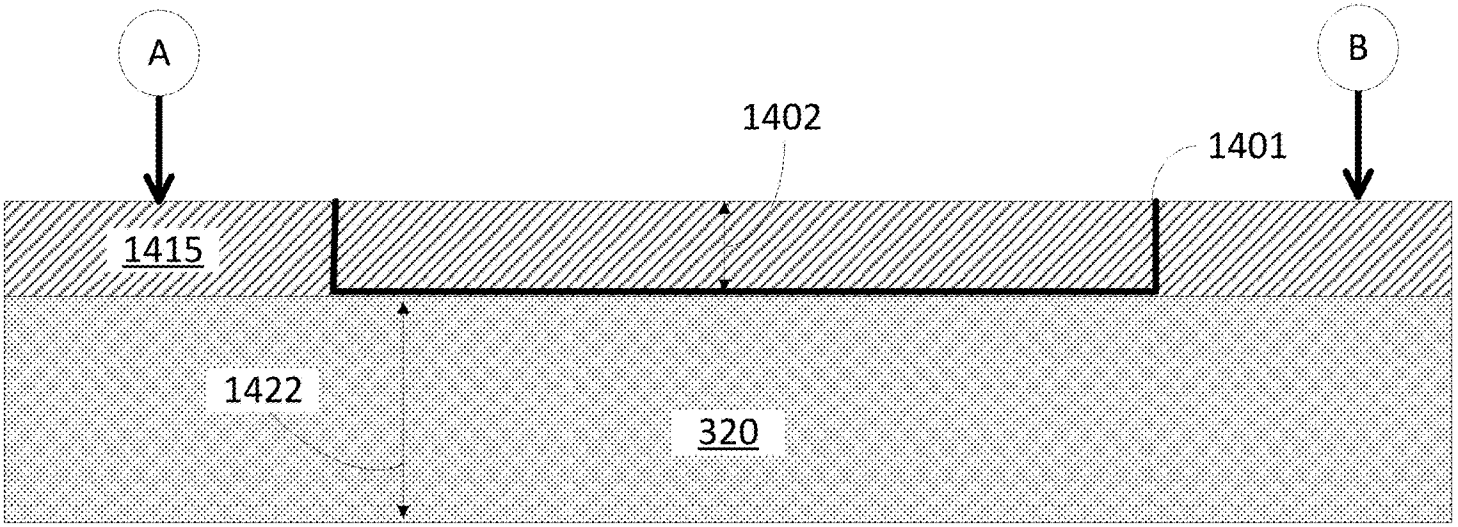

FIGS. 14A-14B illustrate steps in a method of forming a thin substrate layer 1415 having a selected thickness 1402 adjacent to an RF-transparent layer 320, according to some embodiments. FIG. 14A illustrates the step of forming a resistive layer 1401 within a hard material layer 1410. Accordingly, hard material layer 1410 in FIG. 14A may include a conductive material, such as a metal. For example, hard material layer 1410 may include aluminum. Resistive layer 1401 separates a portion of thickness 1402 within hard material layer 1410. Accordingly, the step illustrated in FIG. 14A may include selecting thickness 1402 to obtain a desired RF-transmissivity in the resulting thin substrate layer. For example, when hard material layer 1410 includes aluminum, thickness 1402 may be selected from a transmissivity spectrum curve (e.g., curves 210, cf. FIG. 2). Step 14B includes anodizing hard material layer 1410 to form thin substrate layer 1415. Accordingly, step 14B may include placing anodization electrodes A and B in contact with hard material layer 1415 at points separated by resistive layer 1401. As a result, RF-transparent layer 320 having thickness 1422 is formed adjacent to thin substrate layer 1415. Thus, during anodization, a current flow through hard material layer 1410 from electrode A to electrode B ceases at a point where the oxide layer (e.g., RF-transparent layer 320) makes contact with resistive layer 1401. The anodization process stops when the current flow ceases.

The method illustrated in FIGS. 14A-14B provides thin substrate layer 1415 with a highly accurate thickness 1402. Thickness 1402 may be accurately determined to as low as a few nm by controlled formation of resistive layer 1401 within hard material layer 1410. In that regard, resistive layer 1401 may be simply a resistive channel inside hard material layer 1410, the channel having thickness 1402. In such configuration, resistive layer 1401 may form an indentation inside hard material layer 1410.

Embodiments of antenna windows and methods of manufacturing the same as disclosed herein may also be implemented with other sensors included in electronic device 10. Patch 60 may thus be configured to be a window or a platform for a sensing element in an interior portion of electronic device housing 150. In some embodiments, the sensing element may include a capacitively coupled electrical circuit. For example, in some embodiments patch 60 may include a touch sensitive pad, or a 'track pad' configured to receive, process, and measure a touch from the user. The touch sensitive pad may be capacitively coupled to an electronic circuit configured to determine touch position and gesture interpretation.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A housing for an electronic device capable of radio frequency (RF) wireless communication, the housing comprising:

a substrate formed of a material that passes RF energy in accordance with a substrate thickness, the substrate having a first surface and a second surface opposite the first surface;

an RF transmissive layer formed from the material at the first surface, the RF transmissive layer overlaying at least a portion of the substrate, the portion of the substrate overlaid by the RF transmissive layer comprising (i) a first region characterized as having a first substrate thickness that prevents passage of RF energy and (ii) a second region comprising a recess at the second surface such that the second region has a second substrate thickness that allows passage of RF energy; and an RF transparent material that fills the recess.

2. The housing of claim 1, wherein the second thickness is a threshold thickness to provide a RF transmissivity and structural support for the housing.

3. The housing of claim 2, wherein the RF-transmissivity is at least 4%.

4. The housing of claim 3, wherein the threshold thickness is based an antenna in an interior portion of the housing.

5. The housing of claim 4, wherein the antenna can be used to transmit or receive the RF wireless communication of any one of the following including, Wi-Fi (802.11g at 2.4 GHz, and 802.11a at 5 GHz), Blue-tooth, cellular phone networks and North America 4G LTE at 700 MHz.

6. The housing of claim 5, further comprising one or more additional portions overlaid by the RF transmissive layer comprising respective recesses corresponding to one or more additional antenna each associated with a radio frequency.

7. The housing of claim 6, wherein each of the recesses has a different threshold thickness corresponding to the radio frequency of the associated antenna.

8. The housing of claim 1, wherein the second surface is overlaid with an additional RF transmissive layer formed from the material.

9. The housing of claim 1, wherein the RF transparent material is a polymer.

10. The housing of claim 1, wherein the threshold thickness is less than or equal to 100 nm.

11. An electronic device comprising:

a housing overlaid by an radio-frequency (RF) transmissive layer on a first side, the housing having a first thickness that prevents transmission of RF energy, the housing having an antenna window comprising:

a recess formed in a second side of the housing, opposite the first side, resulting in a corresponding portion of the housing having a second thickness that allows transmission of RF energy; and, an RF transparent material that fills the recess.

12. The electronic device of claim 11, wherein the second thickness is less than or equal to 100 nm.

13. The electronic device of claim 11, wherein the supporting RF transparent material is a thermosetting polymer.

14. The electronic device of claim 11, wherein the housing is aluminum and the RF transmissive layer is anodized aluminum.

15. The electronic device of claim 11, wherein the second thickness has an RF-transmissivity of at least 60%.

16. The electronic device of claim 11, wherein the recess is formed by machining or etching.

17. The electronic device of claim 16, wherein the window is configured to correspond with an antenna in an interior portion of the housing associated with a radio frequency.

18. An electronic device, comprising:

radio-frequency (RF) antennae, each antenna associated with a RF frequency band (RFB) suitable for receiving and transmitting a corresponding RF signal; and, a housing formed of RF opaque material and comprising RF transmissive portions corresponding to each of the antenna, wherein the transmissive portions each comprise an RF transmissive layer and a threshold thickness of RF opaque material selected to be RF transmissive for the RF signal corresponding to the antenna, the threshold thickness being different for each RF transmissive portion.

19. The electronic device of claim 18, wherein the threshold thickness for each RFB is selected such that a RF-transmissivity for each respective RF signal is at least 60%.

20. The electronic device of claim 18, wherein the RFB can be any one of the following including, Wi-Fi (802.11g at 2.4 GHz, and 802.11a at 5 GHz), Blue-tooth, cellular phone networks and North America 4G LTE at 700 MHz.

* * * * *